US009168404B2

(12) United States Patent
Riordan

(10) Patent No.: US 9,168,404 B2
(45) **Date of Patent: *Oct. 27, 2015**

(54) VAPOR BARRIER STRUCTURE

(71) Applicant: Joseph Riordan, Black Diamond, WA (US)

(72) Inventor: Joseph Riordan, Black Diamond, WA (US)

( * ) Notice: Subject to any disclaimer, the term of this patent is extended or adjusted under 35 U.S.C. 154(b) by 46 days.

This patent is subject to a terminal disclaimer.

(21) Appl. No.: 14/048,372

(22) Filed: Oct. 8, 2013

(65) Prior Publication Data

US 2014/0034640 A1 Feb. 6, 2014

Related U.S. Application Data

(63) Continuation of application No. 13/626,039, filed on Sep. 25, 2012, now Pat. No. 8,616,398, which is a continuation-in-part of application No. 12/662,655, filed on Apr. 27, 2010, now Pat. No. 8,297,460.

(60) Provisional application No. 61/213,265, filed on May 21, 2009.

(51) Int. Cl.

| | |
|---|---|
| ***B65D 90/42*** | (2006.01) |
| ***A62C 3/06*** | (2006.01) |
| ***B65D 90/38*** | (2006.01) |

(52) U.S. Cl.

CPC ..... *A62C 3/065* (2013.01); *B65D 90/38* (2013.01); *B65D 90/42* (2013.01)

(58) Field of Classification Search

CPC ..... B65D 90/38; B65D 90/42; A62C 3/06; A62C 3/065

USPC ..... 220/88.1, 88.2, 216, 219, 227, 560.01; 169/66, 68; 428/32.22, 920

See application file for complete search history.

(56) References Cited

U.S. PATENT DOCUMENTS

| | | | |
|---|---|---|---|
| 2,797,141 | A | 6/1957 | Veatch et al. |
| 2,936,834 | A | 5/1960 | Gomory |
| 3,192,877 | A | 7/1965 | Wright |
| 3,401,818 | A | 9/1968 | Hagen |
| 3,687,329 | A | 8/1972 | Baum |
| 3,697,422 | A | 10/1972 | Mackie |
| 3,822,807 | A | 7/1974 | MacDonald et al. |
| 3,998,204 | A | 12/1976 | Fuchs et al. |
| 4,303,732 | A | 12/1981 | Torobin |

(Continued)

FOREIGN PATENT DOCUMENTS

| | | |
|---|---|---|
| DE | 4135678 A1 | 5/1993 |
| FR | 2602977 | 2/1888 |

(Continued)

OTHER PUBLICATIONS

European Patent Office; European Search Report for EP 10164411; Feb. 3, 2011; European Patent Office; The Hague, Netherlands.

*Primary Examiner* — Fenn Mathew
*Assistant Examiner* — Madison L Poos
(74) *Attorney, Agent, or Firm* — Kelly Kordzik; Matheson Keys & Kordzik PLLC

(57) ABSTRACT

A barrier system including a plurality of buoyant members, at least some of the plurality of buoyant members having a heat-resistant core, a median layer thrilled on an outer surface of the heat-resistant core, and an antistatic layer formed on an outer surface of the median layer, wherein at least some of the plurality buoyant members are configured for adhering to other buoyant members.

24 Claims, 7 Drawing Sheets

(56) References Cited

U.S. PATENT DOCUMENTS

| | | | |
|---|---|---|---|
| 4,361,190 | A | 11/1982 | Szego |
| 5,097,907 | A | 3/1992 | Alhamad et al. |
| 5,816,332 | A | 10/1998 | Alhamad |
| 6,062,417 | A | 5/2000 | Evans |
| 6,171,689 | B1 | 1/2001 | Kaytor et al. |
| 6,220,469 | B1 | 4/2001 | Basseches |
| 7,331,400 | B2 | 2/2008 | rowen |
| 2007/0284120 | A1 | 12/2007 | Rowen |
| 2010/0294761 | A1 | 11/2010 | Riordan |

FOREIGN PATENT DOCUMENTS

| | | | |
|---|---|---|---|
| GB | 1454492 | | 11/1976 |
| GB | 2454723 | A | 5/2009 |
| WO | WO 2011/152836 | A1 | 12/2011 |

VAPOR BARRIER STRUCTURE

CROSS-REFERENCE TO RELATED APPLICATIONS

This application is a continuation of U.S. patent application Ser. No. 13/626,039, which is a continuation-in-part application of U.S. patent application Ser. No. 12/662,655, which claims the benefit of U.S. Provisional Patent Application Ser. No. 61/213,265, filed May 21, 2009, all of which are hereby incorporated by reference herein.

TECHNICAL FIELD

The present disclosure relates in general to storage tanks for flammable liquids, and particularly to a vapor barrier for flammable liquid storage tanks that provides a vapor impermeable barrier layer with fire-suppressing capabilities for covering as surface of the flammable liquid.

BACKGROUND AND SUMMARY

Flammable liquids, such as oil, gasoline and the like, must be stored in specialized storage tanks due to the flammable vapor that forms above the liquid surface. A common storage tank, often used in the petrochemical industry, is the "floating roof" tank. A typical floating roof tank is illustrated in FIG. 2. Tank 100 includes a hollow cylindrical housing 112 having an open upper end. The open upper end is sealed by a buoyant cover 114, having a circular contour matching the dimensions of the interior of housing 112. Cover 114 floats on the flammable liquid L contained within the housing 112, thus providing a seal between the surface of the liquid L and the outside environment, preventing the buildup of flammable vapor (and exposure thereof to external hazards, such as sparks).

Typically, the cover 114 is fabricated from metal and has a hollow chamber divided by walls into an array of pontoons in order to provide sufficient flotation to carry the weight of the cover plus additional weight, such as the weight of snow which might form on the cover 114. In older oil tank equipment, the cover was constructed of a metal plate with pontoons mounted beneath the cover plate, while modern tanks typically have the pontoons located above the metal cover plate. Repairs to the cover may require welding equipment, which can be used only after the tank has been taken out of service in order to ensure that the cover is clean and that there are no flammable vapors present. If any flammable vapors are present during repair work on the cover, such as the repair of a pontoon of the cover, a spark from the welding may ignite an explosive burning of the vapor.

Repairs may also be made without taking the tank out of service. For example, one of the pontoons may sustain a relatively small opening through which liquid can seep resulting in a loss of buoyancy. By means of an access port, a person may enter the pontoon and apply foamed urethane plastic as a liquid that later hardens to maintain buoyancy. Use of the plastic is not intended as a permanent repair because the plastic may become impregnated with the flammable liquid. Further, the plastic is disadvantageous because, at the conclusion of the service interval when reconditioning is mandatory, it is very difficult to remove the plastic so as to be able to clean the cover and make any permanent repairs. Obviously, welding cannot be employed for repair until all liquid and liquid soaked flotation, such as the foamed plastic, has been removed.

As an alternative procedure of repair, one might consider insertion in the pontoons of hollow, non-foamed plastic bodies to provide sufficient buoyancy so that it is not necessary to repair the leak in the pontoon. However, the use of a plastic hollow body, such as a hollow ball, has been avoided in the petrochemical industry because such a plastic body is electrically insulating and susceptible to developing a static electric charge. There is a danger that the flotation body may suddenly discharge via a spark, which can ignite an explosion.

Additionally, in the past, foam products have also been applied to the surfaces of flammable liquids, creating an effective vapor seal between the flammable liquid and the vapor space thereabove. However, the foam degrades within as short period of time, thus defeating the desired suppression qualities. Moreover, foam applied in the event of a flammable-liquids fire is the traditional form of fire fighting, with the intent of the foam being to cool the surface of the liquid and to also separate the flammable liquid from contact with oxygen, thus suppressing the fire. The difficulty with this traditional method of using foam is that the strong convective hot air currents caused by the fire tend to displace the foam, thus exposing the flammable liquid to the existing fire.

Further, marine vessels currently do not typically employ any physical barrier between a stored flammable liquid and the vapor space formed thereabove. Typically, such vessels employ inert gas generators that create an oxygen-deficient gas that is maintained above the flammable liquid in order to preclude the flammable vapor from mixing with oxygen that might otherwise create a flammable atmosphere. Such systems, however, do not provide backup prevention in case the gas generator fails.

Aspects of the present invention provide a vapor barrier for flammable liquid storage tanks with a gas impermeable layer for covering the surface of a flammable liquid stored within a conventional flammable liquid storage tank. The vapor barrier may further provide fire-suppression capabilities, and it should be understood that the vapor barrier may be applied to tankers, vessels, barges, or any other type of container for flammable liquids. Such a vapor barrier prevents the build-up of flammable vapors over the flammable liquid surface. The vapor barrier is formed from a plurality of spherical buoyant members. Each spherical buoyant member may have a beat-resistant core or shell, a heat-reactive intumescent or flame retardant layer formed on an outer surface of the heat-resistant COM or shell, and an antistatic layer formed on an outer surface of the heat-reactive intumescent layer. The antistatic layer may be formed from an oil-phobic material. Further, each spherical buoyant member may have a specific gravity selectively chosen so that the spherical buoyant members float at a desired level within the flammable liquid. An outer layer of an adhesive epoxy is then applied to the buoyant members, which may be molded into a desired shape or form with a curing process.

BRIEF DESCRIPTION OF THE DRAWINGS

Similar reference characters may denote corresponding features throughout the attached drawings.

DETAILED DESCRIPTION

Figure 1:
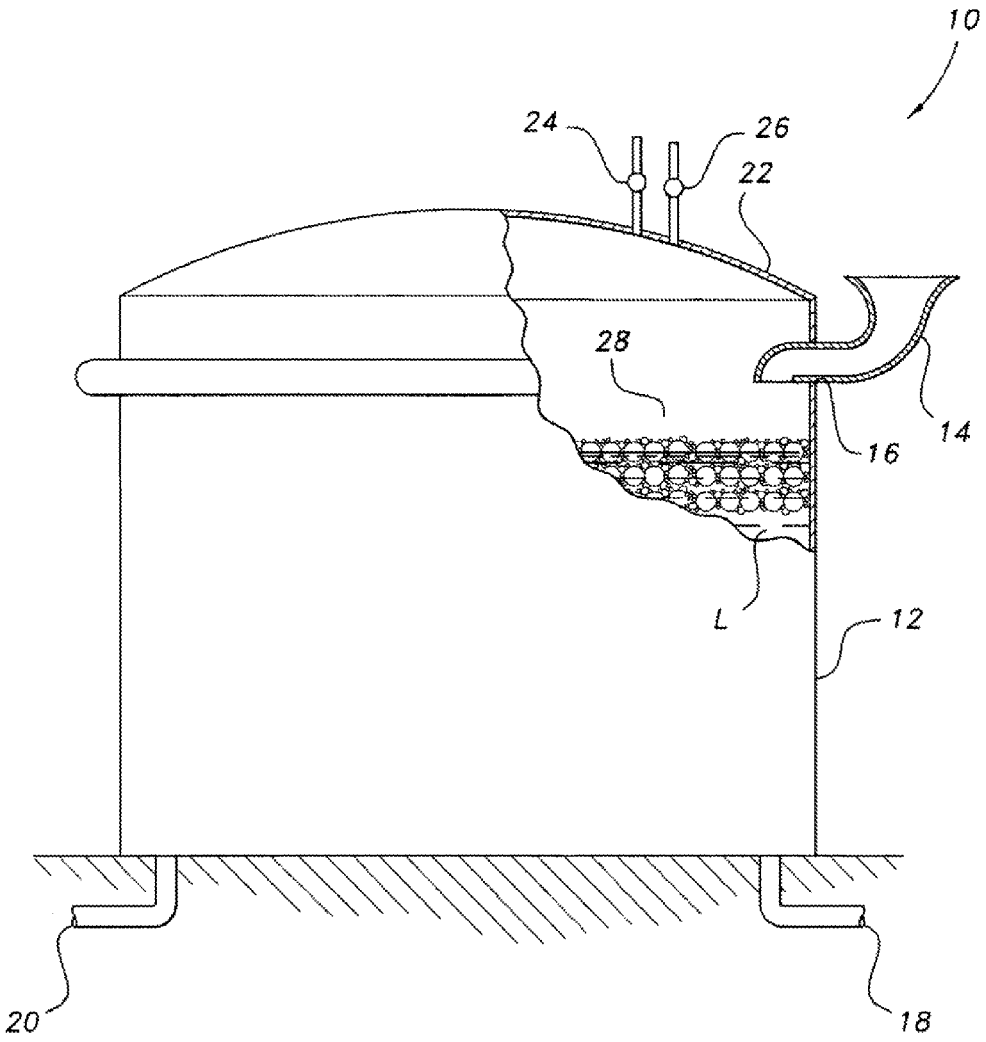
FIG. 1 is an environmental front view of a flammable liquid storage tank, the tank being broken away to show a vapor barrier for flammable liquid storage tanks according to embodiments of the present invention.

Referring to FIG. 1, an exemplary storage tank 10 has a vapor harder for flammable liquid storage tanks deployed therein, the barrier being designated generally as 28. In addition to simply preventing the escape of vapor, the vapor barrier 28 may further provide fire suppression capabilities. It should be understood that such a vapor barrier may be applied to storage tankers, vessels, barges, Or any other type of container for flammable liquids. The liquid storage tank 10 is shown for exemplary purposes only and includes elements conventionally found in storage tanks for flammable liquids, such as oil, gasoline, and the like. The housing 12 may be formed from steel or the like, as is conventionally known, and is either supported above the ground surface, or is at least partly buried in the ground. The tank 10 may be provided with a cover 22 and with pipes 18 and/or 20 for admitting flammable liquid L into the open interior region of housing 12, and for the withdrawal thereof when required. It should be understood that the vapor barrier 28 may be used with any suitable type of flammable liquid L, such as liquid natural gas, petroleum oil, gasoline, or the like.

Upon the surface of the liquid L is provided at least one layer of buoyant bodies or spheres forming the vapor barrier layer 28, as will be described in greater detail below. The cover 22 may be further provided with a vent 26 and/or with an admission valve 24 for admitting an inert gas to the space above the stored liquid L, as is conventionally known. A port 16 may be formed through a sidewall of the housing 12, allowing the selective insertion of the vapor barrier layer 28 (in the form of individual spherical members, as will be described below) within the housing 12 via a chute 14. It should be understood that the chute 14 is shown for exemplary purposes only. It should be further understood that the vapor barrier layer 28 may be introduced into housing 12 in any suitable manner, such as, for example, through existing tank openings. Port 16 and chute 14 are shown for exemplary purposes only.

Figure 3:
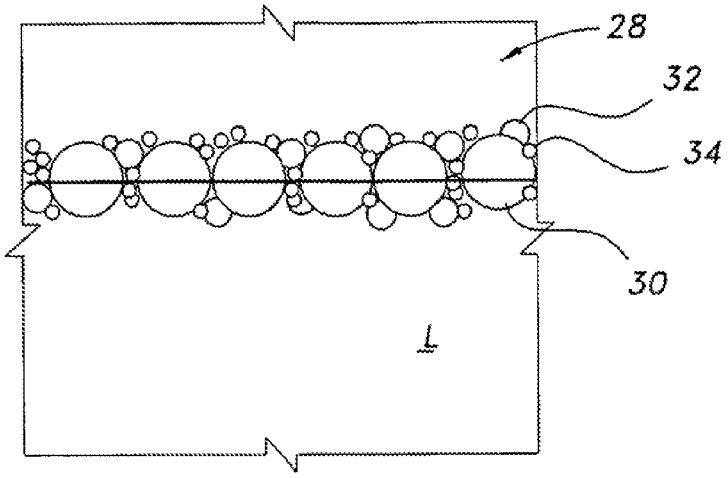
FIG. 3 is an environmental, partial side view of a vapor barrier for flammable liquid storage tanks according to embodiments of the present invention.

Referring to FIG. 3, the vapor barrier 28 may be formed as a buoyant layer through the stacking of multiple sizes of buoyant members 30, 32, 34. Each buoyant member 30, 32, 34 may be spherical, the buoyant members 30 having the largest radii, the buoyant members 34 having the smallest radii, and the buoyant members 32 having radii therebetween. It should be understood that the relative dimensions illustrated in FIG. 3 are shown for exemplary purposes only, and that a narrower or wider variety of buoyant members having distinct radii may be utilized, including members of substantially equivalent sizes. Furthermore, embodiments disclosed herein may comprise any one or more of the buoyant members 30, 32, and 34.

The spherical contour of the buoyant members 30, 32, 34 allows for a stacked, interlocking arrangement, as shown in FIG. 3, the buoyant members naturally settling under the three of gravity into a gas-impermeable layer when inserted into the housing 12 to float on the surface of flammable liquid L. The specific gravity of the buoyant members 30, 32, 34 may be in a range of between 0.05 and 0.5 so that the buoyant members 30, 32, 34 will remain partially submerged within liquid L, as shown, when flammable liquid L is a common flammable material, such as petroleum oil or gasoline. It should be understood that the specific gravity may be varied, depending upon the particular composition of the flammable liquid L. The specific gravity may be selected such that the buoyant members are partially submerged so that the buoyant members provide a lower cross-sectional area below the level of the liquid L in the event of thermal wind currents or convective thermal air currents generated within the tank 10 in the event of a fire.

As shown in FIG. 3, the vapor barrier layer 28 may firm a suppressing blanket effect for the surface of liquid L, minimizing possible liquid-vapor contact within tank 10 (of FIG. 1). In embodiments disclosed herein, the smaller spherical bodies 32, 34 fill in gaps between the larger bodies 30, thus blocking potential evaporation paths from the surface of the liquid L. Additional layers create interstitial vapor pockets, trapping vapors therein and preventing the release thereof into the area above the vapor barrier 28.

Figure 4:
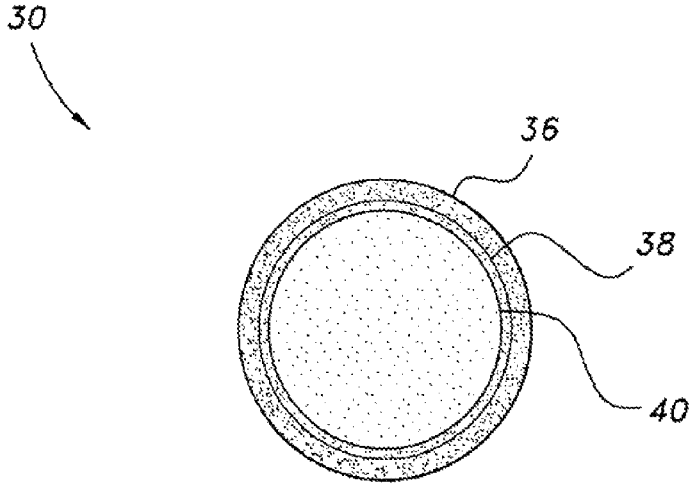
FIG. 4 is a sectional view of a single buoyant member of a vapor barrier for flammable liquid storage tanks according to embodiments of the present invention.

As shown in FIG. 4, each buoyant member may be formed from three layers. A single buoyant member 30 is shown in FIG. 4, although it should be understood that buoyant members 32, 34 may be formed from identical materials, although having differing radii. A central layer or core 40 may be formed from a material that is non-reactive to petroleum products and that can withstand temperatures of approximately 350° F. or greater without melting. Although shown as being solid, it should be understood that core 40 may also be in the form of a hollow shell or the like. The core 40 may be coated with an intumescent layer 38. In the event of as fire within tank 10 of FIG. 1, the intumescent layer 38, which may be heat reactive, expands, thus ensuring that buoyant members 30, 32, 34 form a vapor-impermeable barrier. Alternatively, the intumescent layer 38 may be replaced (or combined) with to flame-retardant material, thus providing protection for the core 40. Heat-reactive, expanding foam materials that are non-reactive with petroleum products and that can withstand relatively high temperatures are well known, and any suitable heat-reactive intumescent material (or, alternatively, flame retardant material) may be utilized. In use, the smaller buoyant members, as illustrated in FIG. 3, may fall into the spaces between the larger buoyant members, thus forming a nearly continuous barrier against escaping vapor. This continuous barrier acts as a floating roof for preventing escape of the flammable vapor. In use, with liquid natural gas or a similar substance, which is a liquid at cryogenic temperatures, the vapor barrier 28 forms a thermal insulation layer, preventing the cryogenic liquid from boiling off too quickly.

As noted above, alternatively, the middle layer 38 (see FIG. 4) may be formed from any suitable flame retardant material, the flame retardant material replacing the intumescent material. The middle layer 38 is also referred to herein as the intumescent layer 38, the fire retardant layer 28 or the median layer. The outer layer 36 may be formed from oil-phobic and/or antistatic material. The outer layer 36 is also referred to herein as the oil-phobic and antistatic layer 36. Layer 36 may be further hydrophobic. The outer layer 36 may be formed from, for example, a high-density plastic resin mixed with an antistatic additive or agent. The antistatic agent is effective in converting the electrically insulating plastic into an electrically conductive material that does not develop as static electrical charge. Antistatic materials are well known. One example of such a material capable of being mixed with a high-density plastic resin is manufactured under the mark GLYCOSTAT, manufactured by Lonza® of Fair Lawn, N.J. It should be understood that the core 40, the intumescent and/or fire retardant layer 38, and the oil-phobic and/or antistatic layer 36 may be formed from any suitable materials so that the overall structure has a specific gravity within a range of approximately 0.05 and 0.5.

The spherical buoyant members 30, 32, 34 may have any desired size (e.g., within as range of approximately 1/16 of an inch to four inches in diameter). It should be understood that members 30, 32, 34 may include all three layers of material, or may include any combination thereof. For example, intumescent and/or flame retardant coating 38 may be applied at a relatively large thickness, and thus may only be able to be applied to the largest members 30 in order to maintain buoyancy. In this example, members 32, 34 would only include the core 40 and the antistatic and/or oil-phobic coating 36. Alternatively, the intumescent and/or flame retardant material may be used as an outer shell for the spherical members, rather than being solely formed in the core. It should be understood that any combination of the above-described layers and materials may be used, depending upon the liquid and the container.

Figure 2:
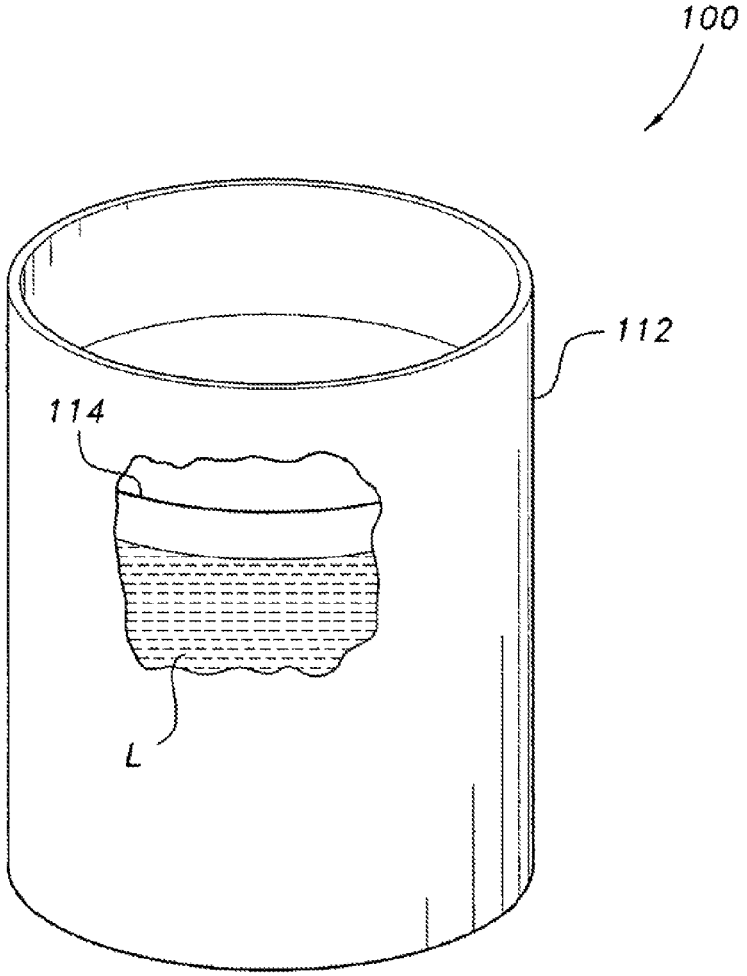
FIG. 2 PRIOR ART
FIG. 2 is a perspective view of a flammable liquid storage tank according to the prior art, broken away to show a portion of the interior of the tank and contents thereof.
Figure 5:
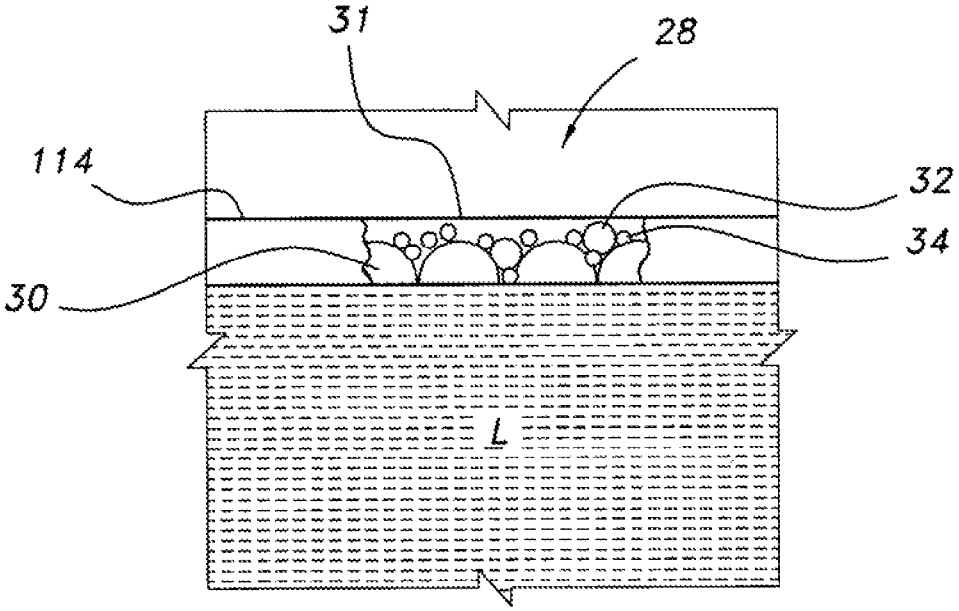
FIG. 5 is an environmental, diagrammatic front view of a vapor barrier for flammable liquid storage tanks according to embodiments of the present invention.

FIG. 5 illustrates an embodiment of the vapor barrier in which the vapor barrier layer 28 is combined with a conventional floating roof, or cover, 114 (see FIG. 2). Such floating roofs may be formed as circular pans having a planar floor and a raised peripheral rim defining an open interior region in the upper side thereof. Such roofs may sink due to environmental conditions, such as earthquakes or other external stresses, causing the pan to tilt and thus fill with liquid L. Some floating roofs include a central drain, but this can become clogged by snow or ice, for example.

In FIG. 5, a floating roof 114 is positioned within the tank, as in FIG. 2, but with a bag 31 containing members 30, 32, and 34 positioned within the open interior region thereof. The bag 31 is firmed from a readily dissolvable material so that if floating roof 114 sinks, the bag 31 will dissolve in liquid L and a vapor barrier layer 28 will cover the surface of liquid L as described above, thus adding an additional layer of protection. It should be understood that any suitable number of bags 31 containing members 30, 32, 34 may be positioned within the upper interior region of roof 114, and that the bags 31 may be formed of any suitable material that is readily dissolvable in a petroleum-based liquid. Additionally, it should be understood that any suitable type of container may be utilized, and that bag 31 is shown for exemplary purposes only.

Figure 6:
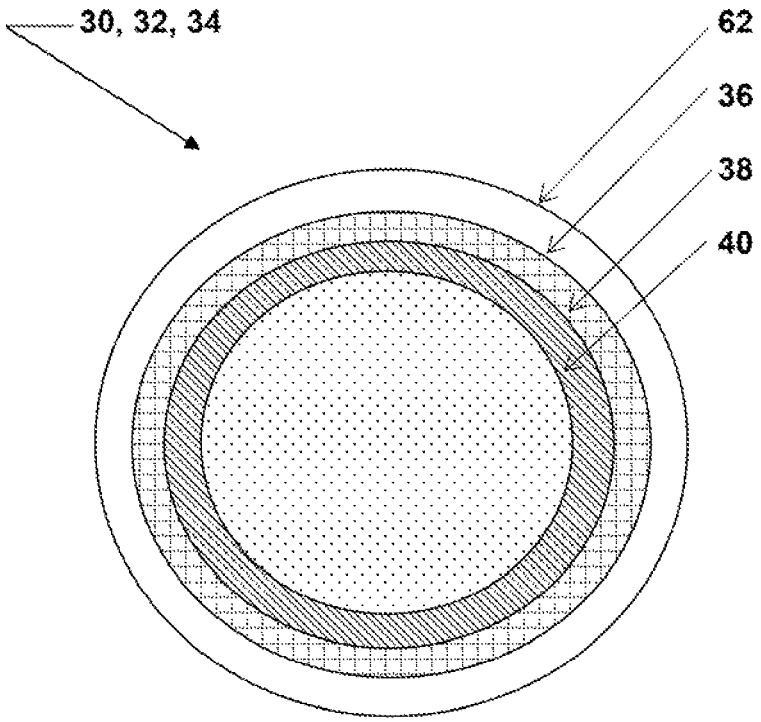
FIG. 6 is a sectional view of a single buoyant member of a vapor barrier for flammable liquid storage tanks according to embodiments of the present invention.

FIG. 6 illustrates an alternative embodiment of the present invention in which to plurality of the spheres 30, 32, 34 may be fixed in position by the addition of an outer coating of adhesive 62, such as epoxy resin, that binds the spheres one to another to create a solid formation of spherical members that serves as the vapor barrier 28 once cured. This may be useful where a plurality of spheres is being joined together as a vapor barrier is desired over loose spheres and/or where fixing the layers in position improves the vapor barrier. The solid formation of spheres 30, 32, 34 may be formed by applying the final coating of adhesive 62, such as epoxy resin, to at least some of the plurality of spheres 30, 32, 34, and while still uncured they may be placed into a mold (not shown) until cured. The solid formation of spheres once cured may be of any three-dimensional shape or form (e.g., dimensions that enable construction and ease of handling) and/or to a desired thickness of layered spheres. The solid formation of spheres may then be joined with other solid formation(s) of spheres to create a vapor barrier surface that covers the flammable liquid, in a similar manner as previously described with respect to FIGS. 1, 3, and 5.

Figure 7:
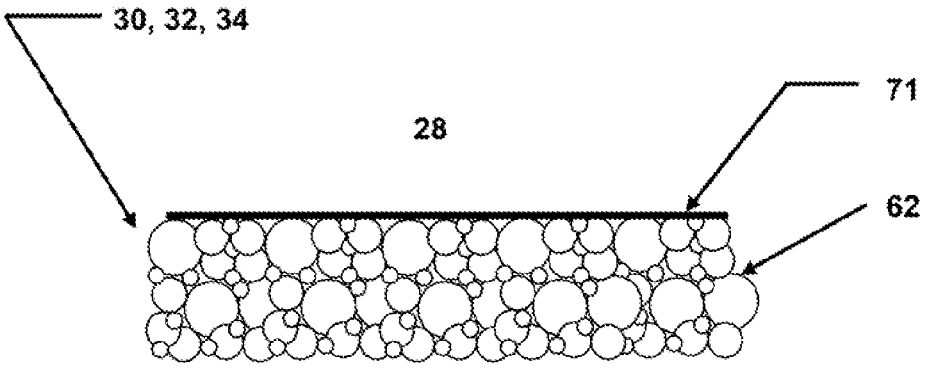
FIG. 7 is a sectional view of a vapor barrier for flammable liquid storage tanks according to embodiments of the present invention.
Figure 8:
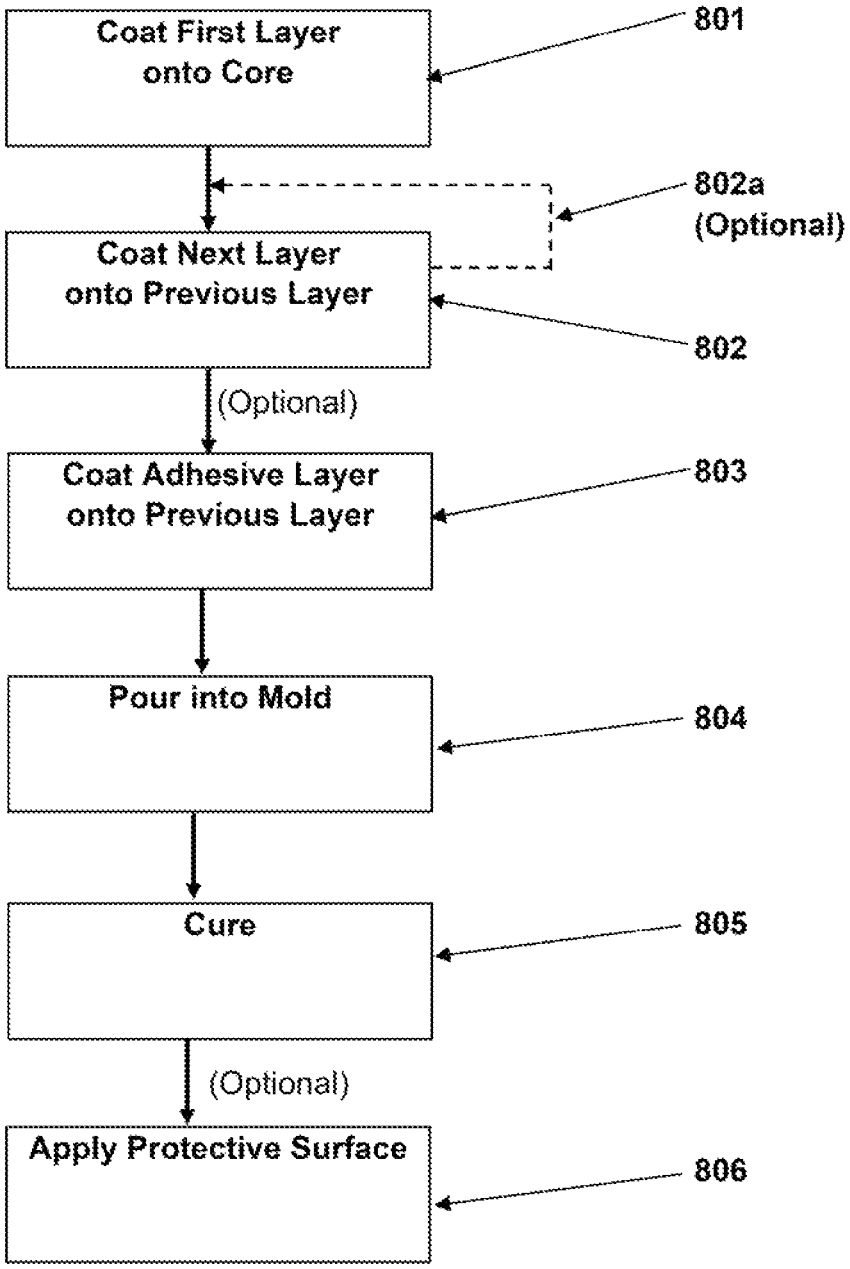
FIG. 8 is a flow diagram according to embodiments of the present invention.

Referring to FIG. 8, a process of creating the spheres may be performed as a batch process using a tumbler or alternatively a prilling tower by starting with a nucleus material such as a styrofoam sphere or other suitable spherical shape, which serves as a framework or foundation upon which the desired layers are built up by adding each successive layer as a liquid which coats the spherically shaped framework or foundation. In step 801, the first (e.g., structural) layer (e.g., layer 40) may be applied as a liquid, e.g., epoxy resin (e.g., in the case of a tumbler, tumbling action causes spheres to contact and rub against each other, thus coating the spheres with the first layer 40). In step 802, the next layer, e.g., an intumescent coating 38, may be added when the previous coating, e.g., epoxy coating 40, is cured. A next layer 36, e.g., an oil-phobic with anti-static additive, may be optionally added in step **802*a*** when the intumescent coating is cured.

Where it is desired to create a solid matrix of spheres adhered one to another, in step 803, an adhesive coating 62, e.g., epoxy resin or similar glue-like material, may be added. In step 804, while still uncured, the batch may be poured or placed into a mold for curing in step 805 into a desired shape as determined by the mold. Alternatively, instead of a tumbling process for the final coating, the individual spheres may be added in layers in dry form to the mold with the epoxy resin sprayed, e.g., as an aerosol, on top of each layer of spheres, thus coating individual spheres, with the cured result being a solid form of spheres in the desired shape of the mold. Optionally, in an additional step 806, a protective layer (e.g., a textile or rubber material, which may be compatible with the flammable liquid, serving to protect the matrix of spheres (e.g., provide protection from the sun or other environmental, physical, or chemical effects)) may be added to one or more surfaces of the solid formation of spheres, such as placed or laid upon the final cured shape, and may be adhered in place using a compatible glue. FIG. 7 illustrates such an additional layer 71. Such a protective layer 71 may be sufficiently sturdy to provide a surface suitable for a person to walk upon.

As noted above, the vapor barrier may be applied to any type of storage tank, storage vessel, etc. For example, the vapor barrier may be used with conventional rectangular tanks or irregularly shaped tanks, such as those typically found on crude oil tankers or barges. Such tankers and barges typically have no floating vapor seal due to the difficulties of maintaining a scaling surface during the turbulent and oscillatory motion of the flammable liquid while the vessel is in motion.

In embodiments, the vapor barrier acts to suppress the evaporation of the flammable liquid into the vapor space above the liquid surface, and further provides a thermally activated barrier in the event of a fire. In embodiments, the spheres provide an effective thermal barrier absent sufficient heat to activate the intumescent layer. In embodiments, in the presence of sufficient heat (e.g., a fire within the tank, above the liquid surface), the barrier would be formed by the reaction of the intumescent layers of the spheres. Further, as noted above, the spheres may be added to the tank following a detection of fire in order to suppress the fire, either in support of or in lieu of, fire fighting foam or other substances. Additionally, it should be understood that the spherical members may have additional coatings applied thereto. For example, another layer, in the form of an outer coating may be formed about layer 36, or layer 62, with the outer coating being oil-absorbent to wick up oil during an oil spill on water. Alternatively, the antistatic and/or oil-phobic coating 36 may be replaced by an antistatic and/or oil-philic coating.

What is claimed:

1. A tank, comprising:

a hollow housing having an open upper end, the housing defining a tank suitable for holding a liquid therein; and a barrier having a plurality of members, at least some of the plurality of members having a heat-resistant core and one or more layers formed on the heat-resistant core, wherein the one or more layers are selected from the group consisting of a median layer and an antistatic layer, the barrier suitable for floating on and forming a surface covering the liquid, wherein at least some of the plurality of members are configured for adhering to other members.

2. The tank as recited in claim 1, wherein the median layer comprises a heat-reactive intumescent material.

3. The tank as recited in claim 1, wherein the median layer comprises a flame retardant material.

4. The tank as recited in claim 1, wherein the plurality of members includes a plurality of sets of spherical buoyant members, each of the sets having a uniform, unique buoyant member radius.

5. The tank as recited in claim 4, wherein each the spherical buoyant member has a diameter in a range of approximately 1/16 of an inch to about four inches.

6. The tank as recited in claim 1, wherein each member has a specific gravity in a range of approximately 0.05 to approximately 0.5.

7. The tank as recited in claim 1, wherein the antistatic layer is hydrophobic and oil-phobic.

8. The tank as recited in claim 1, wherein the antistatic layer is oil-philic.

9. The tank as recited in claim 1, wherein the at least some of the plurality of members configured for adhering to other members have an adhesive outer layer configured for adhering to the other members.

10. The tank as recited in claim 9, wherein the adhesive outer layer comprises an epoxy resin.

11. The tank as recited in claim 1, further comprising:

a floating roof having an upper, open interior region defined therein and a lower surface suitable for floating on a surface of the liquid, wherein the barrier is disposed within the upper, open interior region of the floating roof.

12. The tank as recited in claim 7, wherein the median layer comprises a heat-reactive intumescent material.

13. The tank as recited in claim 7, wherein the median layer comprises a flame retardant material.

14. The tank as recited in claim 1, further comprising a protective outer layer of textile or rubber material on at least one surface of the barrier.

15. The tank as recited in claim 8, wherein the median layer comprises a heat-reactive intumescent material.

16. The tank as recited in claim 8, wherein the median layer comprises a flame retardant material.

17. A barrier system comprising a plurality of members, at least some of the plurality of members having a heat-resistant core and one or more layers formed on the heat-resistant core, wherein the one or more layers are selected from the group consisting of a median layer and an antistatic layer, wherein at least some of the plurality of members are configured for adhering to other members.

18. The barrier system as recited in claim 17, wherein the median layer comprises a heat-reactive intumescent material.

19. The barrier system as recited in claim 17, wherein the median layer comprises a flame retardant material.

20. The barrier system as recited in claim 17, wherein at least some of the plurality of members have a specific gravity in a range of approximately 0.05 to approximately 0.5.

21. The barrier system as recited in claim 17, wherein the antistatic layer is oil-phobic.

22. The barrier system as recited in claim 17, wherein the antistatic layer is oil-philic.

23. The barrier system as recited in claim 17, wherein at least some of the plurality of members have an adhesive outer layer configured for adhering to other buoyant members.

24. The barrier system as recited in claim 23, further comprising a protective layer on at least one surface of the barrier system.

* * * * *